US010578254B2

(12) United States Patent
Wang

(10) Patent No.: US 10,578,254 B2
(45) Date of Patent: Mar. 3, 2020

(54) LED LIGHT SOURCE LAMPSHADE WITH SELF-LOCKING AND PRE-TIGHTENING DEVICE

(71) Applicant: Meiling Wang, Shanghai (CN)

(72) Inventor: Meiling Wang, Shanghai (CN)

(73) Assignee: Katerra, Inc., Menlo Park, CA (US)

( * ) Notice: Subject to any disclaimer, the term of this patent is extended or adjusted under 35 U.S.C. 154(b) by 0 days.

(21) Appl. No.: 16/262,652

(22) Filed: Jan. 30, 2019

(65) Prior Publication Data

US 2019/0293244 A1 Sep. 26, 2019

(51) Int. Cl.
*F21K 9/237* (2016.01)
*F21V 17/18* (2006.01)
*F21Y 115/10* (2016.01)

(52) U.S. Cl.
CPC ..... *F21K 9/237* (2016.08); *F21V 17/18* (2013.01); *F21Y 2115/10* (2016.08)

(58) Field of Classification Search
CPC ..... F21K 9/237; F21V 17/18; F21V 17/168; F21Y 2115/10
See application file for complete search history.

(56) References Cited

U.S. PATENT DOCUMENTS 10,178,717 B2 1/2019 Seyler
2011/0227489 A1 9/2011 Huynh
(Continued)

FOREIGN PATENT DOCUMENTS

CN 201359262 Y * 12/2009
CN 203052288 U * 7/2013 ..... F03D 80/10
CN 206694328 U * 12/2017

OTHER PUBLICATIONS

Notice of Allowance dated Jun. 11, 2019, U.S. Appl. No. 16/197,003, filed Jan. 20, 2018, Applicant: Shanfu Gao, 15 pages.

*Primary Examiner* — Anh T Mai
*Assistant Examiner* — Glenn D Zimmerman
(74) *Attorney, Agent, or Firm* — Haverstock & Owens LLP

(57) ABSTRACT

The present invention disclosed an LED light source lampshade with a self-locking and pre-tightening device, which relates to the field of illuminating devices. The LED light source lampshade with a self-locking and pre-tightening device comprises a lampshade and a lamp body, wherein a side wall of the lampshade comprises an outer side wall of the lampshade and a plurality of connecting ribs, wherein a gap is provided between every two adjacent connecting ribs, wherein a limiting slot is provided between each connecting rib and the outer side wall of the lampshade, wherein a length of the connecting rib is greater than the length of the outer side wall of the lampshade, wherein a rotating boss is provided on an outer side surface of each of the plurality of connecting rib, so that the cross section of the side wall of the lampshade is in an approximately "concave" shape; the edge of the upper end surface of the lamp body is surrounded by a plurality of limiting slots, wherein a pre-tightening groove is provided between the adjacent two limiting ribs, wherein a self-locking groove is provided on one end of the pre-tightening groove near the guiding groove, wherein the lamp body is connected with the lampshade, wherein the rotating boss is matched with the pre-tightening groove. The LED light source lampshade with a self-locking and pre-tightening device provided by the present invention has advantages of simple structure, convenient installation and high production efficiency of the lampshade.

6 Claims, 2 Drawing Sheets

(56) References Cited

U.S. PATENT DOCUMENTS

| | | | | |
|---|---|---|---|---|
| 2012/0299489 | A1 | 11/2012 | Huynh | |
| 2013/0162149 | A1 | 6/2013 | Vande Ven | |
| 2013/0249426 | A1 | 9/2013 | Tao | |
| 2013/0313991 | A1 | 11/2013 | Pan | |
| 2014/0175996 | A1 | 6/2014 | Yoon | |
| 2014/0300269 | A1* | 10/2014 | Wu | F21K 9/232 313/318.01 |
| 2015/0043212 | A1 | 2/2015 | Coffey | |
| 2015/0098230 | A1* | 4/2015 | Tamura | F21V 19/005 362/382 |
| 2016/0034137 | A1 | 11/2016 | Dekker | |
| 2017/0138542 | A1 | 5/2017 | Gielen | |
| 2018/0363893 | A1 | 12/2018 | Cheng | |
| 2019/0120438 | A1 | 4/2019 | Wan | |

* cited by examiner

LED LIGHT SOURCE LAMPSHADE WITH SELF-LOCKING AND PRE-TIGHTENING DEVICE

RELATED APPLICATIONS

This application claims priority to and the benefit of Chinese Patent Application No. CN201810247721.0, filed on Mar. 23, 2018, and entitled "LED LIGHT SOURCE LAMPSHADE WITH SELF-LOCKING AND PRE-TIGHTENING DEVICE", the content of which is hereby incorporated in its entirety by reference.

FIELD OF THE INVENTION

The invention relates to the technical field of lighting devices, in particular to an LED light source lampshade with a self-locking and pre-tightening device.

BACKGROUND OF THE INVENTION

Currently, the LED light source lampshade in the market is connected to a lamp body mainly by buckles or glue. In the actual producing process of buckles, the mould of buckle is relatively complicate, and demolding is not an easy job and the efficiency of positioning needed in the installation is not high. There is also a risk of breakage of buckles in a whole lamp drop test. In the case of glue, the production efficiency for manufacturing moulds, which is ready for fixing it with glue, is not high, and it may increase production cost imperceptibly.

SUMMARY OF THE INVENTION

Aiming at the above mentioned problems existing in the prior art, it is intended to provide an LED light source lampshade with a self-locking and pre-tightening device, wherein the lamp body is provided with a rotary self-locking and pre-tightening device, a certain inclined angle is provided on the upper surface of the pre-tightening blocking groove, the lampshade is provided with a plurality of rotating bosses, a guiding oblique angle is designed on each of the plurality of bosses, on each of the plurality of bosses a certain inclined angle is provided. This LED light source lampshade with a self-locking and pre-tightening device has advantages of simple structure, convenient installation and high production efficiency of the lampshade.

The specific technical solutions are as follows:

An LED light source lampshade with a self-locking and pre-tightening device, comprising:

a lampshade, wherein the lampshade is an arc-shaped shell, a side wall of the lampshade comprises an outer side wall of the lampshade and a plurality of connecting ribs, wherein a gap is provided between every two adjacent connecting ribs, wherein a limiting slot is provided between each of the plurality of connecting ribs and the outer side wall of the lampshade, wherein a length of the connecting rib is greater than the length of outer side wall of the lampshade, wherein a rotating boss is provided on an outer side surface of each of the plurality of connecting ribs, so that the cross section of the side wall of the lampshade is approximately "concave";

a lamp body in the shape of an inverted circular truncated cone, wherein a plurality of limiting ribs are disposed about an outer periphery of an edge of an upper end surface of the lamp body, wherein a guiding groove is provided between every two adjacent limiting ribs, wherein a pre-tightening blocking groove is further formed on one side of a bottom of the guiding groove, wherein a self-locking buckle is provided on one end of the pre-tightening blocking groove near the guiding groove, wherein the lamp body is connected with the lampshade, wherein the rotating boss is matched with the pre-tightening blocking groove.

In the LED light source lampshade with a self-locking and pre-tightening device according to the present invention, the number of the plurality of the connecting ribs and the plurality of limiting ribs is four, respectively.

In the LED light source lampshade with a self-locking and pre-tightening device according to the present invention, the rotating boss is in a waist-type hole shape, and a length direction of the rotating boss is running along the circumference of the connecting rib.

In the LED light source lampshade with a self-locking and pre-tightening device according to the present invention, the number of the rotating boss is four, wherein an angle formed between an upper end surface and a lower end surface of each rotating boss is 1°, wherein a left side height of each rotating boss is lower than a right side height thereof.

In the LED light source lampshade with a self-locking and pre-tightening device according to the present invention, the number of the pre-tightening blocking groove is four, wherein an angle formed between the upper end surface and the lower end surface of two of the pre-tightening blocking grooves is 3°, wherein the left side height of this two pre-tightening blocking grooves are higher than the right side height thereof.

In the LED light source lampshade with a self-locking and pre-tightening device according to the present invention, each rotating boss is connected to each pre-tightening groove by interference fit.

The above-mentioned technical solutions have the following advantageous effects: the LED light source lampshade with a self-locking and pre-tightening device provided by the present invention has a lamp body, which is provided with a rotary self-locking and pre-tightening device, a certain inclined angle is formed on the upper surface of the pre-tightening blocking groove, the lampshade is provided with a plurality of rotating bosses, a guiding oblique angle is designed on each of the plurality of bosses, and on each of the plurality of the bosses, a certain inclined angle is provided. This LED light source lampshade with self-locking and pre-tightening device has advantages of simple structure, convenient installation and high production efficiency of the lampshade.

BRIEF DESCRIPTION OF THE DRAWINGS

The accompanying drawings, together with the specification, illustrate exemplary embodiments of the present disclosure, and, together with the description, serve to explain the principles of the present invention.

Figure 1:
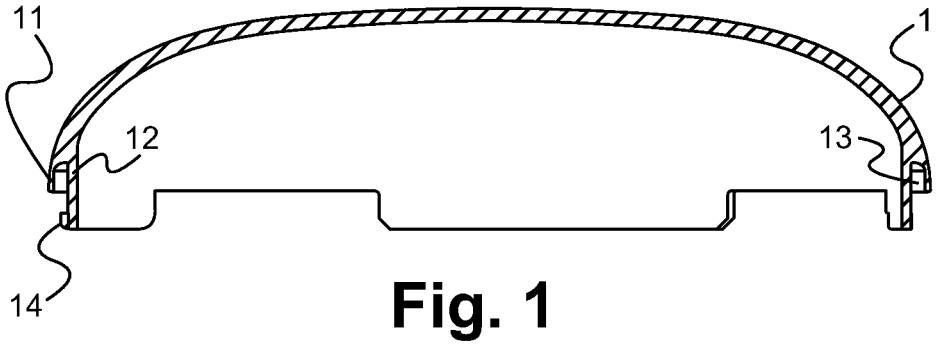
FIG. 1 is a schematic view showing a structure of a lampshade of an LED light source lampshade with a self-locking and pre-tightening device in one embodiment of the present invention.

In the accompanying drawings: 1 lampshade; 11 outer side wall of the lampshade; 12 connecting rib; 13 limiting slot; 14 rotating boss; 2 lamp body; 21 limiting rib; 22 guiding groove; 23 pre-tightening blocking groove; 24 self-locking buckle.

DETAILED DESCRIPTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, the term "plurality" means a number greater than one.

Hereinafter, certain exemplary embodiments according to the present disclosure will be described with reference to the accompanying drawings.

Figure 2:
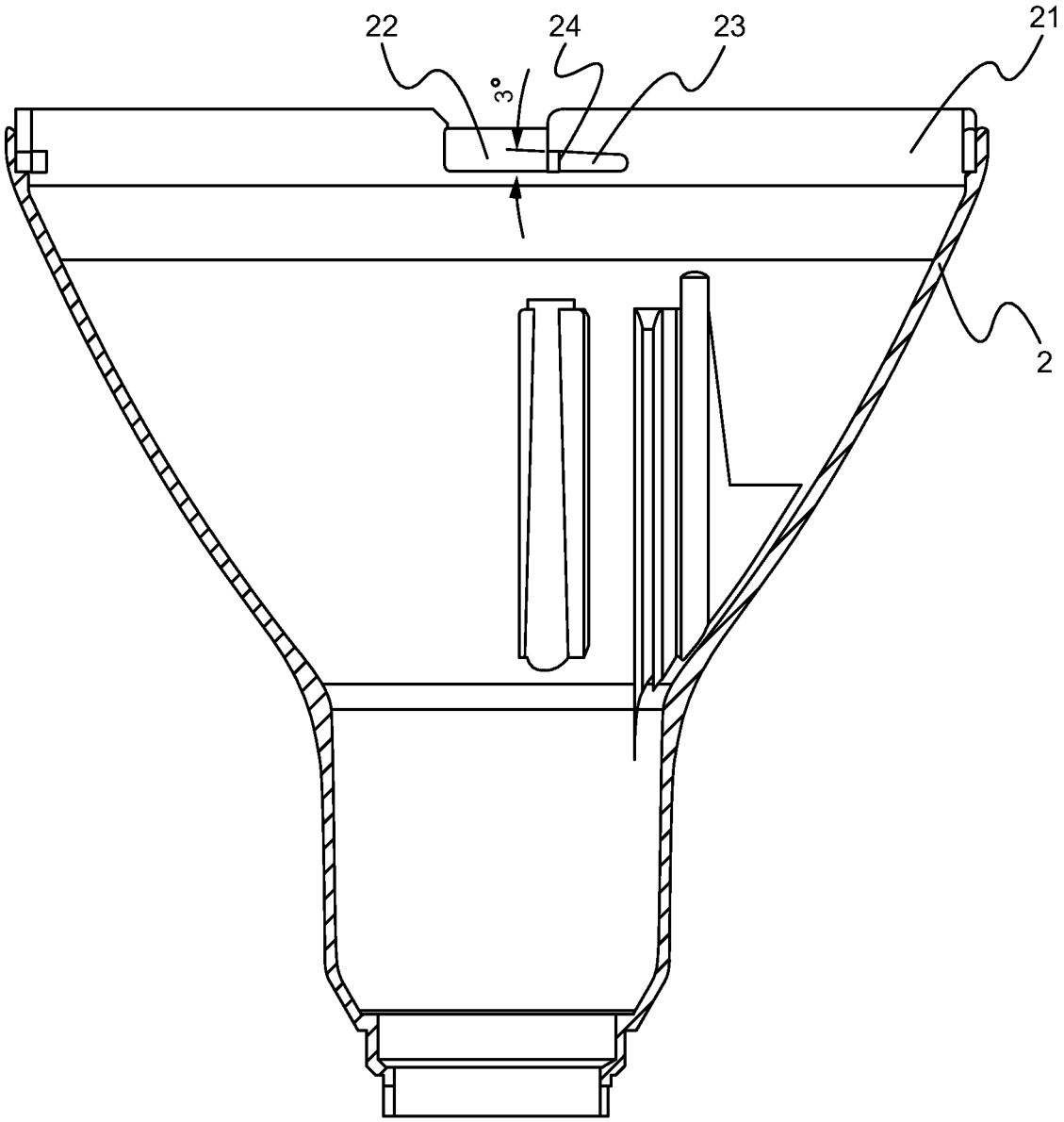
FIG. 2 is a schematic view showing a structure of a lamp body of an LED light source lampshade with a self-locking and pre-tightening device in one embodiment of the present invention.
Figure 3:
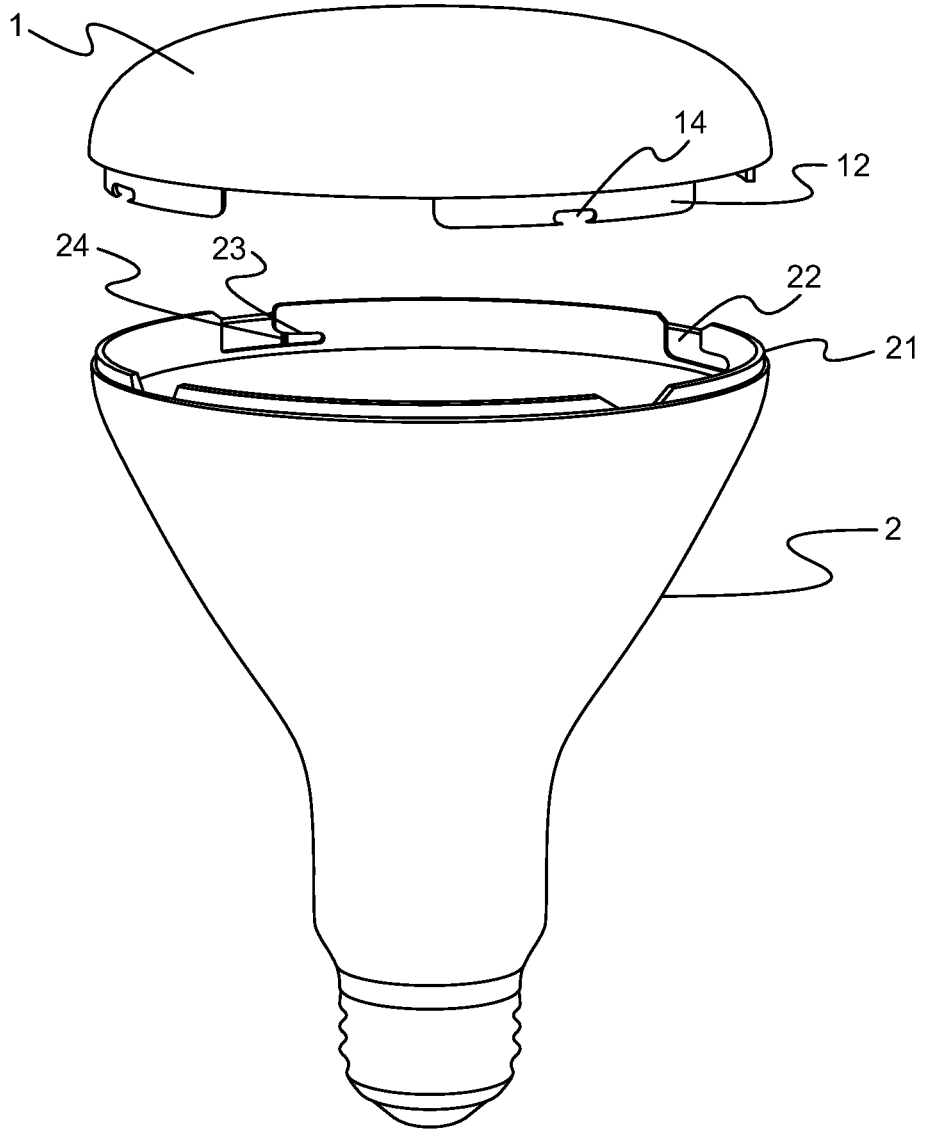
FIG. 3 is a schematic view showing an assembly structure of a lampshade and a lamp body of an LED light source lampshade with a self-locking and pre-tightening device in one embodiment of the present invention.

In order to make the technical means, creative features, achievable aims and effects achieved by the present invention easy to understand, one embodiment of an LED light source lampshade with a self-locking and pre-tightening device according to the present invention will now be specifically described in conjunction with FIGS. 1 to 3.

FIG. 1 is a schematic view showing an internal structure of an LED light source lampshade with a self-locking and pre-tightening device in one embodiment of the present invention; FIG. 2 is a schematic view showing an exterior structure of an LED light source lampshade with a self-locking and pre-tightening device in one embodiment of the present invention; FIG. 3 is a sectional view showing a local structure of an LED light source lampshade with a self-locking and pre-tightening device, wherein the LED light source lampshade with a self-locking and pre-tightening device comprises: a lampshade 1, an outer side wall of the lampshade 11, a plurality of connecting ribs 12, a plurality of limiting slots 13, a plurality of rotating bosses 14, a lamp body 2, a plurality of limiting ribs 21, a plurality of guiding grooves 22, a plurality of pre-tightening blocking grooves 23 and a self-locking buckle 24.

In the embodiment, lampshade 1 is designed to have an arc shape, a side wall of the lampshade 1 comprises an outer side wall of the lampshade 11 and a plurality of connecting ribs 12, a gap is provided between every two adjacent connecting ribs 12, a limiting slot 13 is arranged between each of the plurality of connecting ribs 12 and the outer side wall of the lampshade 11, wherein a length of the connecting rib 12 is greater than the length of the outer side wall of the lampshade 11, and a rotating boss 14 is provided on an outer side of each of the plurality of connecting ribs 12, so as to allow the cross section of the side wall of the lampshade to be formed into an approximately "concave" shape.

The lamp body is designed to have an inverted circular truncated cone, a plurality of limiting ribs are disposed about an outer periphery of an edge of an upper end surface of the lamp body 2, the guiding groove 22 is arranged between every two adjacent limiting ribs 21, the pre-tightening groove 23 is further formed on one side of a bottom of the guiding groove 22, the self-locking buckle 24 is arranged at one end of the pre-tightening blocking groove 23 near the guiding groove 22, the lamp body 2 is connected with the lampshade 1, and the rotating boss 14 is designed to match with the pre-tightening groove 23.

In a preferred embodiment, the number of the connecting ribs 12 and the limiting ribs 21 is four, respectively, as shown in FIG. 1.

In a preferred embodiment, a plurality of the rotating boss 14 are arranged in a waist-type hole shape, and a length direction of the rotating boss 14 is running along the circumference of the connecting rib 12 as shown in FIG. 1.

In a preferred embodiment, the number of the rotating boss 14 is four, and an angle formed between an upper end surface and a lower end surface of each rotating boss 14 is 1°, and the height of the left side of each rotating boss 14 is smaller than the height of the right side thereof, as shown in FIG. 1. When this angle is screwed into the pre-tightening blocking groove 23 and to be matched with the angle of the pre-tightening blocking groove 23 in a certain interference fit, the object of pre-tightening is achieved.

In a preferred embodiment, as shown in FIG. 1, the number of the pre-tightening blocking groove 23 is four, wherein an angle formed between the upper end surface and the lower end surface of two pre-tightening blocking grooves 23 is 3°, and the height of the left side of this two pre-tightening blocking grooves 23 is greater than the height of the right side thereof, wherein this two pre-tightening blocking grooves are used for pre-tightening and self-locking, and the other two pre-tightening blocking grooves are used as installation guides.

In a preferred embodiment, as shown in FIG. 1, the rotating boss 14 and the pre-tightening blocking groove 23 are connected by interference fit.

Hereinafter, a specific embodiment will be described for illustration. It should be noted that structures, processes and materials selected in the following embodiment is merely illustrative of the feasibility of the embodiment and is not intended to limit the scope of the invention.

The installation process of an LED light source lampshade with a self-locking and pre-tightening device is as follows: Step 1, the lampshade is combined with the lamp body through the guiding groove on the lamp body, and is rotated to a pre-tightening and locking position manually or automatically for achieving a pre-tightening and self-locking function; Step 2, the pre-tightening device of the lamp body is designed to have a certain inclined angle, which is to be matched with the rotating boss of the lampshade, the bevel edge being reduced gradually from outside to inside to achieve the object of pre-tightening, when the pre-tightening action reaches to an certain extent, the boss of the lampshade falls into the self-locking device, and then the counterclockwise rotation cannot be performed so as to realize the function of self-locking, the edge of the lamp body is designed with a plurality of ribs for positioning and limiting displacement; Step 3, the lampshade is provided with rotating boss (four points in total), on which the guiding oblique angle is formed, and on the surface of boss, a certain inclined angle is provided, when this inclined angle is screwed into the pre-tightening blocking groove and to be matched with the angle thereof in a interference fit, such that the pre-tightening object can be achieved, the lampshade has a circle of grooves near the outer side to match the circle of the ribs of the lamp body for positioning and limiting displacement.

In the LED light source lampshade with a self-locking and pre-tightening device provided by the present invention, the lampshade 1 is designed into an arc shape, the side wall of the lampshade 1 comprising the outer side wall of the lampshade 11 and four connecting ribs 12, the gap provided between every two adjacent connecting ribs 12, the limiting slot 13 provided between each connecting rib 12 and the outer side wall of the lampshade 1, wherein the length of the connecting rib 12 is greater than the length of the outer side wall of the lampshade 11, the rotating boss 14 provided on the outer side surface of each connecting rib 12, so as to allow the cross section of the side wall of the lampshade to be formed into an approximately "concave" shape. The rotating boss 13 is designed to have a waist-type hole shape, and the length direction of the rotating boss 14 is running along the circumference of the connecting rib 12, and an angle formed between the upper end surface and the lower end surface of each rotating boss 14 is 1°. The height of the left side of each rotating boss 14 is higher than the height of the right side thereof. The lamp body 2 is designed to have an inverted circular truncated cone, and a plurality of limiting ribs 21 are disposed about an outer periphery of an edge of the upper end surface of the lamp body 2, and the guiding groove 22 is provided between every two adjacent limiting ribs 21, the pre-tightening blocking groove 23 is also formed on the side of the bottom of the guiding groove 22, the number of the pre-tightening blocking groove 23 is four, wherein an angle formed between the upper end surface and the lower end surface of two of pre-tightening blocking grooves 23 is 3', wherein the height of the left side of this two pre-tightening blocking grooves 23 is greater than the height of the right side thereof. The self-locking buckle 24 is provided on an end of each pre-tightening blocking groove 23 near the guiding groove 22, the lamp body 2 is connected with the lampshade 1, and the rotating boss 14 is connected with the pre-tightening groove 23 by interference fit.

In the LED light source lampshade with a left-locking and pre-tightening device provided by the present invention, the lamp body has a rotary pre-tightening and self-locking device with a certain inclined angle formed on the upper surface of the pre-tightening blocking groove, the lampshade has a rotating boss with a guiding oblique angle and a certain inclined angle set on the upper surface of the boss, this LED light source lampshade with a self-locking and pre-tightening device have advantages of simple structure, convenient installation and high production efficiency of the lampshade.

The above are only the preferred embodiments of the present invention, and are not intended to limit the scope of the embodiments and the scope of the present invention, and those who skilled in the art should be able to realize that any solution resulting from equivalent replacements and obvious changes made by the description of the present invention and the contents of the drawings should be included within the scope of the invention.

What is claimed is:

1. An LED light source lampshade with a self-locking and pre-tightening device, comprising:

a lampshade, wherein the lampshade is an arc-shaped shell, a side wall of the lampshade comprises an outer side wall of the lampshade and a plurality of connecting ribs, wherein a gap is provided between every two adjacent connecting ribs, wherein a limiting slot is provided between each of the plurality of connecting ribs and the outer side wall of the lampshade, wherein a length of the connecting rib is greater than the length of outer side wall of the lampshade, wherein a rotating boss is provided on an outer side surface of each of the plurality of connecting ribs, so that the cross section of the side wall of the lampshade is approximately concave; and a lamp body is designed to have an inverted circular truncated cone, wherein a plurality of limiting ribs are disposed about an outer periphery of an edge of an upper end surface of the lamp body, wherein a guiding groove is provided between every two adjacent limiting ribs, wherein a pre-tightening blocking groove is further formed on one side of a bottom of the guiding groove, wherein a self-locking buckle is provided on one end of the pre-tightening blocking groove near the guiding groove, wherein the lamp body is connected with the lampshade, wherein the rotating boss is matched with the pre-tightening blocking groove.

2. The LED light source lampshade with a self-locking and pre-tightening device as claimed in claim 1, wherein the number of the plurality of the connecting ribs and the plurality of limiting ribs is four, respectively.

3. The LED light source lampshade with a self-locking and pre-tightening device as claimed in claim 2, wherein the rotating boss is in a waist-type hole shape, and a length direction of the rotating boss is running along the circumference of the connecting rib.

4. The LED light source lampshade with a self-locking and pre-tightening device as claimed in claim 3, wherein the number of the rotating boss is four, wherein an angle formed between an upper end surface and a lower end surface of each rotating boss is 1°, wherein a left side height of each rotating boss is lower than a right side height thereof.

5. The LED light source lampshade with a self-locking and pre-tightening device as claimed in claim 4, wherein the number of the pre-tightening blocking groove is four, wherein an angle formed between the upper end surface and lower end surface of two of the pre-tightening blocking grooves is 3°, wherein the left side height of this two pre-tightening blocking grooves are higher than the right side height thereof.

6. The LED light source lampshade with a self-locking and pre-tightening device as claimed in claim 5, wherein each rotating boss is connected to each pre-tightening groove by interference fit.

* * * * *